US009810099B2

(12) United States Patent
Akturk et al.

(10) Patent No.: US 9,810,099 B2
(45) Date of Patent: Nov. 7, 2017

(54) TURBINE EXHAUST CYLINDER STRUT STRIP FOR SHOCK INDUCED OSCILLATION CONTROL

(71) Applicant: Siemens Energy, Inc., Orlando, FL (US)

(72) Inventors: Ali Akturk, Oviedo, FL (US); Jose L. Rodriguez, Lake Mary, FL (US); David L. Wasdell, Winter Park, FL (US); John A. Orosa, Palm Beach Gardens, FL (US); Matthew D. Montgomery, Jupiter, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 281 days.

(21) Appl. No.: 14/753,384

(22) Filed: Jun. 29, 2015

(65) Prior Publication Data

US 2016/0376929 A1 Dec. 29, 2016

(51) Int. Cl.

| | |
|---|---|
| ***F01D 25/04*** | (2006.01) |
| ***F01D 25/30*** | (2006.01) |
| ***F15D 1/00*** | (2006.01) |
| ***F01D 25/16*** | (2006.01) |

(52) U.S. Cl.

CPC ..... *F01D 25/30* (2013.01); *F01D 25/04* (2013.01); *F01D 25/162* (2013.01); *F15D 1/0025* (2013.01); *F05D 2240/121* (2013.01); *F05D 2260/964* (2013.01)

(58) Field of Classification Search

CPC ..... F01D 25/30; F01D 25/162; F01D 25/04; F01D 5/10; F01D 5/145; F01D 5/16; F01D 5/26; F01D 25/06; F05D 2240/121; F05D 2240/126; F05D 2240/127; F05D 2240/124; F05D 2260/964; F15D 1/0025; F15D 1/003; F15D 1/004; F15D 1/0065

See application file for complete search history.

(56) References Cited

U.S. PATENT DOCUMENTS

| | | | | |
|---|---|---|---|---|
| 2,934,889 | A * | 5/1960 | Poulos | F02K 1/46 138/37 |
| 5,692,709 | A | 12/1997 | Mihora et al. | |
| 7,118,071 | B2 | 10/2006 | Bogue | |
| 7,976,252 | B2 | 7/2011 | McDaniel et al. | |
| 7,976,253 | B2 | 7/2011 | Steadings et al. | |
| 8,302,912 | B2 | 11/2012 | Wood | |
| 2004/0109756 | A1* | 6/2004 | Wakazono | F01D 25/162 415/142 |
| 2010/0301172 | A1 | 12/2010 | Wood | |
| 2010/0301173 | A1 | 12/2010 | Wood | |
| 2013/0064647 | A1* | 3/2013 | Hashimoto | F01D 25/14 415/116 |
| 2016/0069198 | A1* | 3/2016 | Zelesky | F01D 5/186 415/116 |

* cited by examiner

*Primary Examiner* — Gregory Anderson
*Assistant Examiner* — Danielle M Christensen

(57) ABSTRACT

An arrangement to control vibrations in a gas turbine exhaust diffuser is provided. The arrangement includes a protrusion coupled to a turbine exhaust cylinder strut for controlling shock induced oscillations in a gas turbine diffuser. The controlled shock induced oscillations minimize pressure fluctuations in the gas turbine exhaust diffuser such that an unsteadiness of the fluid flow surrounding the turbine exhaust cylinder strut is reduced. A method to fluid flow induced vibrations in a gas turbine diffuser is also provided.

16 Claims, 3 Drawing Sheets

TURBINE EXHAUST CYLINDER STRUT STRIP FOR SHOCK INDUCED OSCILLATION CONTROL

BACKGROUND

1. Field

The present application relates to gas turbines, and more particularly to an arrangement and method to minimize flow induced vibration in a gas turbine exhaust diffuser.

2. Description of the Related Art

The turbine exhaust cylinder and the turbine exhaust manifold are coaxial gas turbine casing components connected together establishing a fluid flow path for the gas turbine exhaust diffuser. The fluid flow path includes an inner flow path and an outer flow path defined by an inner diameter delimiting an outer conical surface of the inner flow path and an outer diameter delimiting an inner conical surface of the outer flow path, respectively. Tangential and/or radial struts, which include the corresponding strut shields that are the aerodynamic surfaces around the tangential and/or radial struts, are arranged within the fluid flow path and serve several purposes such as supporting the flow path and provide a pathway for lubrication piping. Turbine exhaust cylinder (TEC) and turbine exhaust manifold (TEM) struts are arranged in circumferential rows, for example, a circumferential row of TEC struts and a circumferential row of TEM struts in a flow direction, and extend between the outer conical surface and the inner conical surface. Every other TEC strut may be circumferentially aligned (same circumferential location) with a TEM strut.

At certain conditions, the exhaust flow around the struts can cause vibrations of the inner and outer diameter of the TEC and the TEM due to strut flow unsteadiness. The strut flow unsteadiness may cause large oscillations in flowpath pressures that force the flowpath structure to vibrate or even resonate strongly. These vibrations are a potential contributor to damage occurring on the flow path of the TEM and the TEC. This damage to the diffuser flow path may require replacement or repair.

SUMMARY

Briefly described, aspects of the present disclosure relate to an arrangement to control vibrations in a gas turbine exhaust diffuser and a method to control fluid flow induced vibrations in a gas turbine diffuser.

A first aspect provides an arrangement to control vibrations in a gas turbine exhaust diffuser. The arrangement includes a gas turbine exhaust diffuser. The gas turbine diffuser includes a TEM connected to a TEC establishing a fluid flow path, the fluid flow path bounded radially outward by an outer conical surface and bounded radially inward by an inner conical surface. A TEC strut is arranged in the TEC between the outer conical surface and the inner conical surface. A protrusion is disposed on the TEC strut for controlling shock induced oscillations in a gas turbine diffuser. The controlled shock induced oscillations minimize pressure fluctuations in the gas turbine exhaust diffuser such that an unsteadiness of the fluid flow surrounding the TEC strut is reduced.

A second aspect of provides a method for controlling fluid flow induced vibrations in a gas turbine diffuser. The method includes disposing a protrusion on a TEC strut of the gas turbine exhaust diffuser and coupling the protrusion to the TEC strut. The protrusion controls shock induced oscillations which minimizes pressure fluctuations in the gas turbine exhaust diffuser such that an unsteadiness of the fluid flow surrounding the TEC strut is reduced.

DETAILED DESCRIPTION

To facilitate an understanding of embodiments, principles, and features of the present disclosure, they are explained hereinafter with reference to implementation in illustrative embodiments. Embodiments of the present disclosure, however, are not limited to use in the described systems or methods.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

In order to prevent the flow unsteadiness on a TEC strut, a TEC strut strip may be positioned on the TEC strut. Flow unsteadiness on the TEC strut may be driven by transonic shock induced oscillations on the suction side of the TEC strut airfoil leading edge. The transonic shock induced oscillations are created when the fluid flow rate reaches a critical speed through the gas turbine diffuser. Because the flow around the TEC struts is not symmetric, it is further accelerated and creates the transonic shock wave on the suction side of the strut airfoil. In addition, the shock wave causes the fluid flow boundary layer to separate from the TEC strut which may interact with the shock wave to create unsteady pressure fluctuations within the gas turbine diffuser. These unsteady pressure fluctuations may lead to undesirable vibrations of the components of the gas turbine diffuser.

The flow unsteadiness on the TEC strut may be mitigated using the TEC strut strip. The TEC strut strip affects the fluid flow in two significant ways. First the TEC strut strip changes the curvature of the airfoil suction side which prevents the shock wave from forming. Secondly, the TEC strut strip forces the boundary layer to separate from a fixed location. Together these changes eliminate the possibility of the shock-induced oscillations of the boundary layer separation. The TEC strut strip may be embodied as a strip of metal welded near the leading edge of the TEC strut shield which will modify the shape of the strut curvature where the shock wave appears and also force the boundary layer to separate from a fixed point. The result is a boundary layer that is less likely to oscillate at a fixed frequency with high amplitude.

Figure 1:
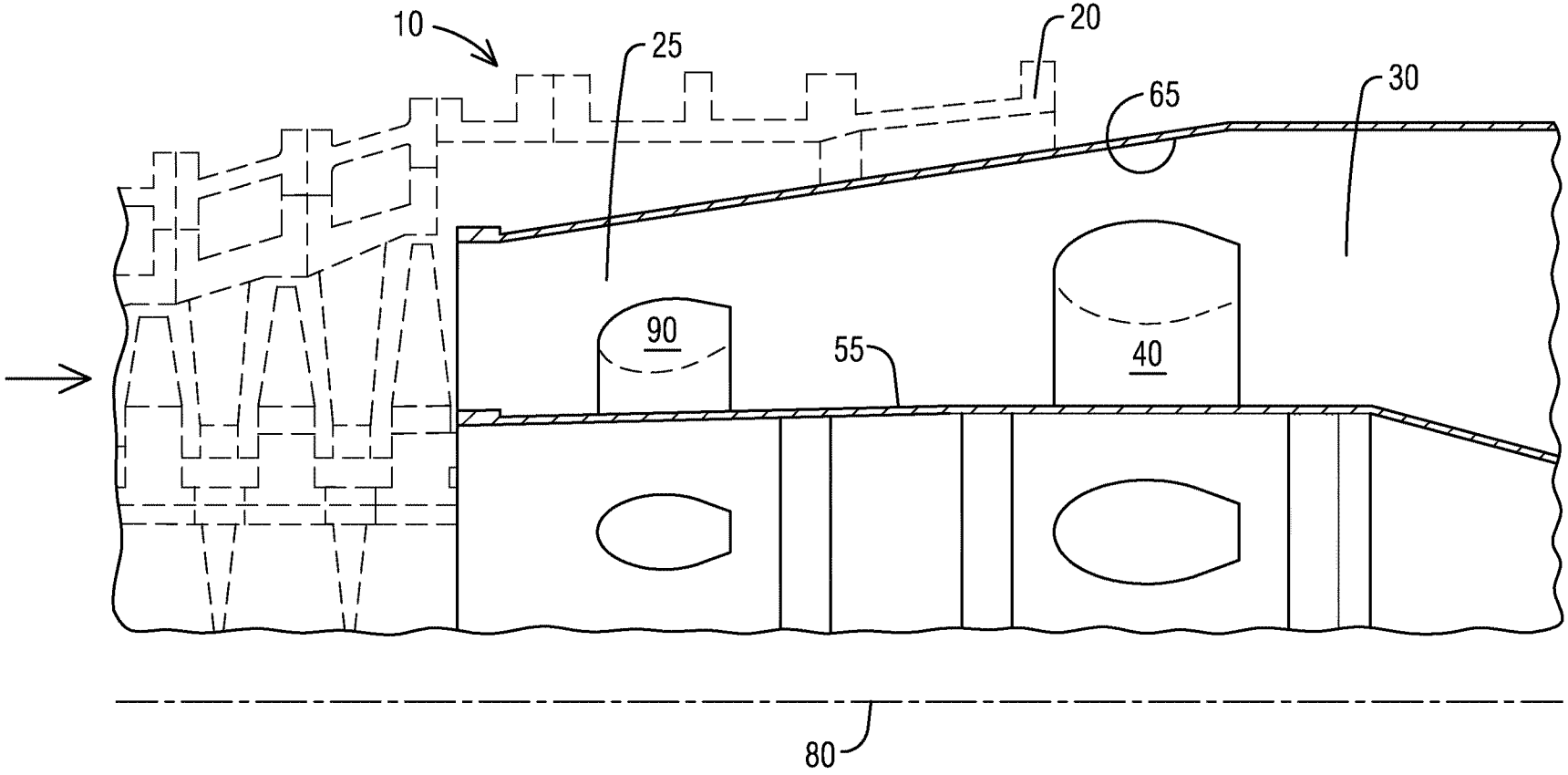
FIG. 1 . . . illustrates a longitudinal view of a gas turbine exhaust diffuser, FIG. 2 . . . illustrates an isometric view of the gas turbine exhaust diffuser including protrusions on the TEC struts, FIG. 3 . . . illustrates a cross sectional view of a rectangular strip, and FIG. 4 . . . illustrates a cross sectional view of the gas TEC strut and the extension of an attached rectangular strip.

FIG. 1 illustrates a longitudinal view of the gas turbine exhaust diffuser (10). The gas turbine exhaust diffuser (10) is disposed in the aft portion of the turbine section of the gas turbine and includes a TEC (20) and a TEM (30). The TEM (30) is connected downstream from the TEC (20) and establishes a fluid flow path (25). The fluid flow path (25) is bounded radially inward by an inner conical surface (55) and radially outward by an outer conical surface (65) with respect to a rotor centerline (80). Struts (40, 90) are hollow tubes that may extend between the inner flow path (25) to the outer flow path (35). A TEC strut (90) is shown within the TEC (20) upstream of a TEM strut (40).

Figure 2:
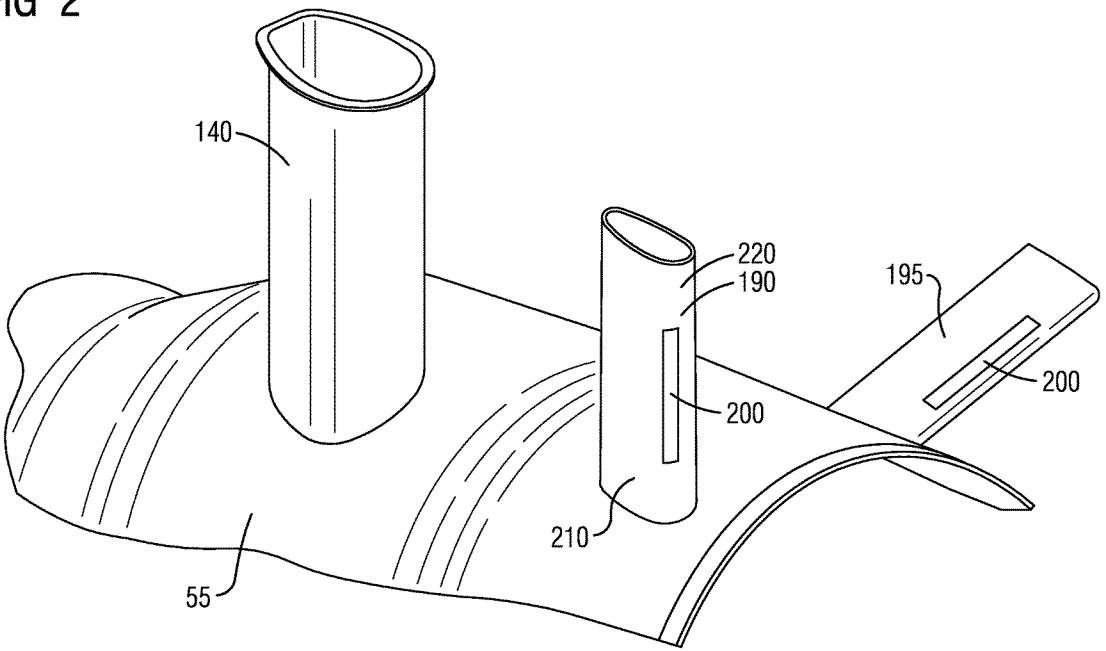

FIG. 2 is an isometric view of the gas turbine exhaust diffuser (10) showing two TEC struts (190, 195) and one TEM strut (140). The TEM strut (140) is disposed downstream from the TEC struts (190, 195). The TEC struts (190, 195) and the turbine manifold struts (140) are shown extending from the inner conical surface (55). The outer conical surface (65) is not shown in this view, however, the struts (140, 190, 195) extend from the inner conical surface (55) to the outer conical surface (65). A first TEC strut (190) is aligned axially in a flow direction with a second TEM strut (140). In this shown embodiment, a protrusion (200) is shown on each TEC strut (190).

In an embodiment, a protrusion (200) is positioned on the suction side (210) of the leading edge of each TEC strut (190) as illustrated in FIG. 2. The protrusion (200) is positioned in order to eliminate the transonic shock wave from forming on the suction side (210) of the strut airfoil and fix the boundary layer separation point as described above. The protrusion (200) may be positioned axially at a distance in a range of 7.5% to 12% of the strut chord length from the leading edge on the suction side (210) to a leading edge (220) of the protrusion (200). Computational Fluid dynamics have shown that this distance is approximately the most forward axial location, with respect to the fluid flow, that the shock wave forms.

Figure 3:
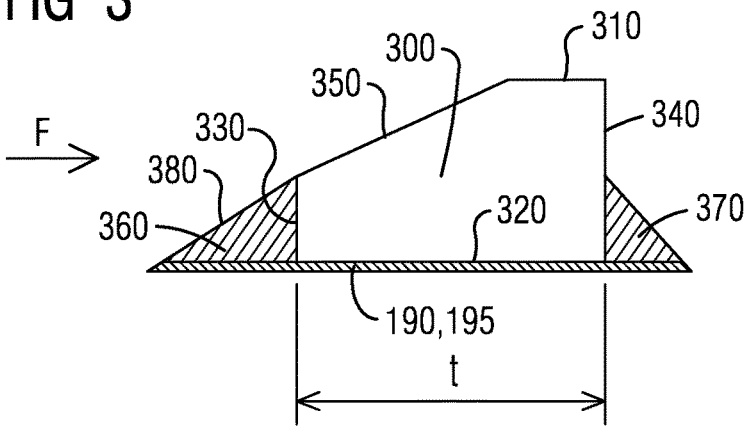

FIG. 3 illustrates a cross sectional view of an embodiment of a protrusion (200). The protrusion (200) may be embodied in a form of a rectangular strip (300) as viewed from a top view. The rectangular strip (300) may include a constant cross section along the span of the strut (190, 195) such as the cross section (300) shown in FIG. 3. In another embodiment, the cross section of the protrusion (200) may be varied. For example, the cross section of the protrusion (200) may vary along the span of the strut (190, 195). However, for illustrative purposes, the protrusion (200) will be described hereinafter as the rectangular strip (300) and will include a constant cross section along the span of the strut (190, 195) as illustrated in FIG. 3.

The rectangular strip includes a bottom face (320) attached to the strut (190), a top face (310) opposite the bottom face (320), a front face (330) facing the oncoming fluid flow (F), and a back face (340) opposite the front face (330). The rectangular strip (300) may be chamfered on a corner of the rectangular strip (300) creating a chamfered edge (350) as illustrated in FIG. 3. The chamfered edge (350) may face the oncoming fluid flow (F) from the leading edge (220) of the TEC strut airfoil (190). A chamfer angle (A) measured from the top face (310) of the rectangular strip (300) may be less than 30°. An angle in this range minimizes the fluid flow field disruption and pressure loss necessary to eliminate the shock and fix the boundary layer separation point.

The rectangular strip (300) may be attached to the TEC strut (190) in a variety of ways. For example, the rectangular strip (300) may be attached by welding, bolting, and/or riveting. In order to attach the rectangular strip (300) to the TEC strut (190), a front attachment zone (360) and/or an aft attachment zone (370) may be utilized.

In an embodiment, the front attachment zone (360) is disposed on the front face (330) of the rectangular strip (300) as illustrated. An edge (380) of the front attachment zone (360) may include an angle with respect to the top face (310) that is essentially the chamfer angle (A) with the result that the chamfered edge (350) and the edge (380) of the front attachment zone (360) form a continuous ramped edge. In another embodiment, the edge (380) of the front attachment zone (360) may include an angle that is 30° or more.

An aft attachment zone (370) may also be utilized in addition to the front attachment zone (360) to attach the rectangular strip (300) to the TEC strut (190). The aft attachment zone (370) may be disposed on the back face (340) as illustrated in FIG. 3. As shown, the aft attachment zone (370) does not extend to the top face (310) such that a sharp backward facing step is produced. The sharp edge of the backward facing step fixes the location of the fluid flow separation which stabilizes the fluid flow. Additionally, a length of the back face (340) may be used to target a desired frequency of oscillation from the separated flow such that the frequency of oscillation is not in an undesired frequency range.

Figure 4:
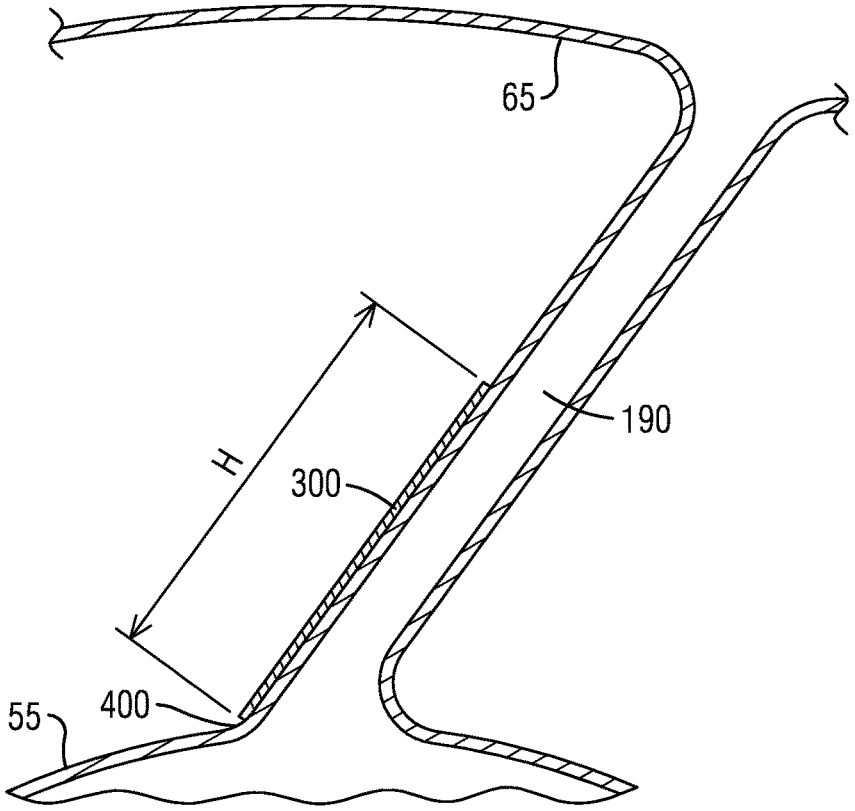

FIG. 4 shows a cross sectional view of a TEC strut (190) and the extension of the attached rectangular strip (300) along the TEC strut (190). A radial height (h) of the rectangular strip (300) measured from the hub (400) of the TEC strut (190) which extends from the inner conical surface (55) may be between 40% and 70% of the span of the strut (190, 195). A radial height (h) in this range and a thickness (t) of the rectangular strip (300) in a range of 3% to 6% of strut maximum thickness have been shown to be effective eliminating the shock wave and fix the boundary layer flow point separation downstream.

The material of the protrusion (300) may be the same material or essentially the same material as that of the TEC strut (190, 195)). Having the same or essentially the same material as that of the TEC strut (190, 195)) would minimize the differential growth between the protrusion and the TEC strut (190, 195) of the gas turbine exhaust diffuser (10). For example, a steel may be used as the material of the protrusion (200).

Referring to FIGS. 1-4, a method to control fluid flow induced vibrations in a gas turbine exhaust diffuser (10) is also provided. In an embodiment, a protrusion (200) is disposed on a TEC strut (190, 195) of the gas turbine exhaust diffuser (10). The protrusion (200) may then be coupled to the TEC strut (190, 195). Coupling the protrusion (200) to the TEC strut (190, 195) controls the shock induced oscillations which minimizes pressure fluctuations in the gas turbine exhaust diffuser (10) such that an unsteadiness of the fluid flow surrounding the TEC strut (190, 195) is reduced.

Disposing the protrusion (200) may include positioning the protrusion (200) on the suction side (210) of the leading edge (220) of a TEC airfoil where the distance from the leading edge (220) of the TEC strut (190, 195) to a leading edge of the protrusion (200) on the suction side (220) in the axial direction is in a range from 7.5% to 12% of the strut chord length. Radially, the protrusion (200) in positioned from the hub (400) of the TEC strut (190, 195) on the inner conical surface (55) and extends radially in a range of 40% to 70% of the span of the strut (190, 195).

The coupling may include welding the protrusion (200) to a surface of the TEC strut (190, 195). While welding will be specifically described other methods of coupling the protrusion (200) to the surface of the TEC strut (190, 195) are also possible. As mentioned previously, other methods of coupling may include bolting, and/or riveting.

When welding is used as the method of coupling the protrusion (200) to the TEC strut (190, 195), a front weld bead (360) may be disposed on a front face (330) of the protrusion (200) and an aft weld bead (370) may be disposed on a back face of the protrusion (200). As described previously, the protrusion (200) may be embodied as a rectangular strip (300) with a chamfered edge (350). An edge (380) of the front weld bead (360) on the front face (330) of the rectangular strip (300) includes the chamfer angle (A) such that the chamfered edge (350) and the rectangular strip (300) from a continuous ramped front edge. The aft weld bead (370) does not extend to the top face (310) of the rectangular strip (300) creating a backward facing step formed above the aft weld bead (370) which fixes the location of the fluid flow separation. When coupling the protrusion (200) by bolting or riveting to the TEC strut strip (190, 195) a front attachment zone (360) and/or an aft attachment zone (370) may be utilized.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. An arrangement to control vibrations in a gas turbine exhaust diffuser, comprising:

a gas turbine exhaust diffuser, comprising:

a turbine exhaust manifold connected to a turbine exhaust cylinder establishing a fluid flow path, the fluid flow path bounded radially outward by an outer conical surface and bounded radially inward by an inner conical surface;

a turbine exhaust cylinder strut comprising a turbine exhaust cylinder strut airfoil arranged in the turbine exhaust cylinder between the outer conical surface and the inner conical surface; and a protrusion disposed on the turbine exhaust cylinder strut for controlling shock induced oscillations in the gas turbine exhaust diffuser, wherein the controlled shock induced oscillations minimize pressure fluctuations in the gas turbine exhaust diffuser such that an unsteadiness of the fluid flow surrounding the turbine exhaust cylinder strut is reduced, wherein the protrusion is a rectangular strip chamfered on a corner of the rectangular strip creating an chamfered edge, wherein the chamfered edge faces the fluid flow from the leading edge of the turbine exhaust cylinder strut airfoil, and wherein a height of the rectangular strip from a hub of the turbine exhaust cylinder strut is between and 40% and 70% of the span of the turbine exhaust cylinder strut.

2. The arrangement as claimed in claim 1, wherein the protrusion is disposed on a suction side of the turbine exhaust cylinder strut airfoil.

3. The arrangement as claimed in claim 2, wherein the protrusion is disposed on the suction side of a leading edge of the turbine exhaust cylinder strut airfoil.

4. The arrangement as claimed in claim 3, wherein a distance from the leading edge of the turbine exhaust cylinder strut to a leading edge of the protrusion on the suction side is in a range from 7.5% to 12% of the strut chord length.

5. The arrangement as claimed in claim 1, wherein a chamfer angle measured from a top face of the rectangular strip to the chamfered edge is less than 30 degrees.

6. The arrangement as claimed in claim 1, wherein the rectangular strip is attached to the turbine exhaust cylinder strut by welding.

7. The arrangement as claimed in claim 6, wherein a front attachment zone comprising a weld bead is disposed on a front face of the rectangular strip such that an angle of an edge of the front attachment zone with respect to the top face is the chamfer angle, and wherein an edge of the front attachment zone and the chamfered edge of the rectangular strip form a continuous ramped front edge.

8. The arrangement as claimed in claim 6, wherein an aft attachment zone comprising a weld bead is disposed on a back face of the rectangular strip, and wherein the aft attachment zone does not extend to the top face of the rectangular strip such that a backward facing step is formed above the aft attachment zone fixing a location of fluid flow separation.

9. The arrangement as claimed in claim 1, wherein a thickness of the rectangular strip is in a range of 3% to 6% of strut maximum thickness.

10. The arrangement as claimed in claim 1, wherein a material of the protrusion is the same as a material of the turbine exhaust cylinder strut.

11. A method for controlling fluid flow induced vibrations in a gas turbine diffuser, comprising:

disposing a protrusion on a turbine exhaust cylinder strut of the gas turbine exhaust diffuser;

coupling the protrusion to the turbine exhaust cylinder strut, wherein the protrusion controls shock induced oscillations which minimizes pressure fluctuations in the gas turbine exhaust diffuser such that an unsteadiness of fluid flow surrounding the turbine exhaust cylinder strut is reduced, wherein the disposing includes positioning the protrusion on the suction side of the leading edge of a turbine exhaust cylinder strut airfoil, and wherein a distance from the leading edge of the turbine exhaust cylinder strut to a leading edge of the protrusion on the suction side is in a range from 7.5% to 12% of the strut chord length.

12. The method as claimed in claim 11, wherein the coupling includes welding the protrusion to a surface of a turbine exhaust cylinder strut.

13. The method as claimed in claim 11, wherein the protrusion is a rectangular strip chamfered on a corner of the rectangular strip creating an chamfered edge, wherein the chamfered edge faces the fluid flow from the leading edge of the turbine exhaust cylinder strut airfoil.

14. The method as claimed in claim 13, wherein the welding includes disposing a front weld bead on a front face of the rectangular strip such that an angle of an edge of the weld bead with respect to the top face is the chamfer angle, and wherein the edge of the weld bead and the chamfered edge of the rectangular strip form a continuous ramped front edge.

15. The method as claimed in claim 13, wherein the welding includes disposing an aft weld bead on a back face of the rectangular strip, and wherein the aft weld bead (370) does not extend to the top face of the rectangular strip such that a backward facing step is formed above the aft weld bead fixing a location of fluid flow separation.

16. The method as claimed in claim 13, wherein a chamfer angle measured from a top face of the rectangular strip to the chamfered edge is less than 30 degrees.

* * * * *